United States Patent [19]

Terry

[11] 4,381,744

[45] May 3, 1983

[54] FLUID TEMPERATURE MONITOR

[75] Inventor: D. A. Terry, Bayles Lake, Loda, Ill. 60948

[73] Assignee: D. A. Terry, Loda, Ill.

[21] Appl. No.: 214,106

[22] Filed: Dec. 8, 1980

[51] Int. Cl.[3] ..... F02B 77/08

[52] U.S. Cl. ..... 123/198 DC; 123/41.15; 123/198 D

[58] Field of Search ..... 123/41.15, 198 D, 198 DC; 165/51

[56] References Cited

U.S. PATENT DOCUMENTS

| | | | |
|---|---|---|---|
| 1,478,084 | 12/1923 | Whittington | 123/41.15 |
| 1,478,090 | 12/1923 | Wood | 123/41.15 |
| 2,389,103 | 11/1945 | Wood | 123/41.15 |
| 2,450,739 | 10/1948 | Schlieder | 123/41.15 |
| 2,618,248 | 11/1952 | Lindberg, Jr. et al. | 123/41.15 |
| 2,930,365 | 3/1960 | Muscato | 123/41.15 |
| 3,893,108 | 7/1975 | McBride, Jr. et al. | 123/198 D |
| 4,019,489 | 4/1977 | Cartmill | 123/41.15 |
| 4,147,151 | 4/1979 | Wright | 123/41.15 |

*Primary Examiner*—Ira S. Lazarus

*Attorney, Agent, or Firm*—Lockwood, Dewey, Alex & Cummings

[57] ABSTRACT

A fluid temperature monitor coupled into the engine coolant fluid circuit of an internal combustion engine includes a thermostat which is responsive to overheating of the fluid to operate a plunger so as to actuate a first switch upon overheating of the fluid to sound a warning alarm and a second switch to turn off the engine.

10 Claims, 4 Drawing Figures

FLUID TEMPERATURE MONITOR

BACKGROUND AND SUMMARY OF THE INVENTION

The present invention relates to a fluid temperature monitor, and more particularly, to a monitor for monitoring the overheating condition of the coolant fluid of an internal combustion engine and preventing damage to the engine.

Unheeded overheating of engine coolants frequently results in serious damage to internal combustion engines. When the normal temperature gauge or indicator of the vehicle has become inoperative or, if they remain operative, but the vehicle operator fails to heed the abnormal temperature warning signals and continues to operate the vehicle in an overheated condition, serious and expensive damage can occur to the engine itself, sometimes to the extent that the entire engine must be replaced.

The present invention is directed to a fluid temperature monitor for preventing serious damage to the engine under such circumstances. The monitor of the present invention is coupled directly into the engine coolant liquid circuit and is continuously bathed in the coolant liquid during operation. When overheating of the coolant liquid occurs, the monitor is actuated so as to sound a visual or audible warning, signaling both the overheated condition and that the engine may soon be stopped, and will then automatically turn off the engine to prevent damage to the engine after a short time delay.

In one principal aspect of the present invention, a fluid temperature monitor includes thermostat means which are operable in response to the temperature of the fluid, warning means, first switch means actuated by the thermostat means to actuate the warning means when the temperature of the fluid reaches a predetermined level, prime mover cutoff means, and second switch means actuated by the thermostat means to actuate the prime mover cutoff means when the temperature of the fluid reaches at least the predetermined level.

In another principal aspect of the present invention, the monitor includes coupling means for coupling it into the engine coolant fluid circuit of an internal combustion engine.

These and other objects, features, and advantages of the present invention will become clear upon consideration of the following detailed description.

BRIEF DESCRIPTION OF THE DRAWING

In the course of this description, reference will frequently be made to the attached drawing in which.

DESCRIPTION OF THE PREFERRED EMBODIMENT

Figure 1:
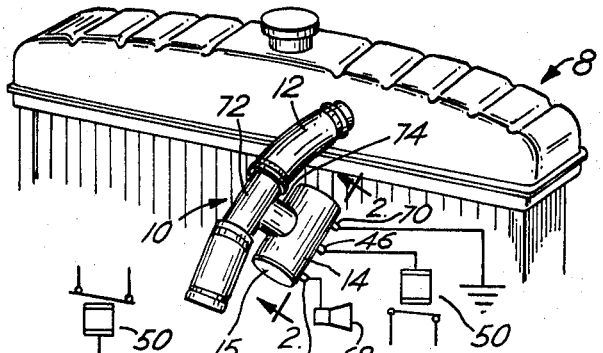
FIG. 1 is a partially broken view of an internal combustion engine radiator showing a preferred embodiment of fluid temperature monitor of the present invention coupled into the engine coolant circuit and showing an abbreviated monitor electrical diagram.

In FIG. 1 a standard internal combustion engine radiator 8 is shown in partially broken view. A preferred embodiment of fluid temperature monitor 10 of the invention is shown in FIG. 1 coupled by conventional radiator hose 12 to the top inlet of the radiator 8.

Figure 2:
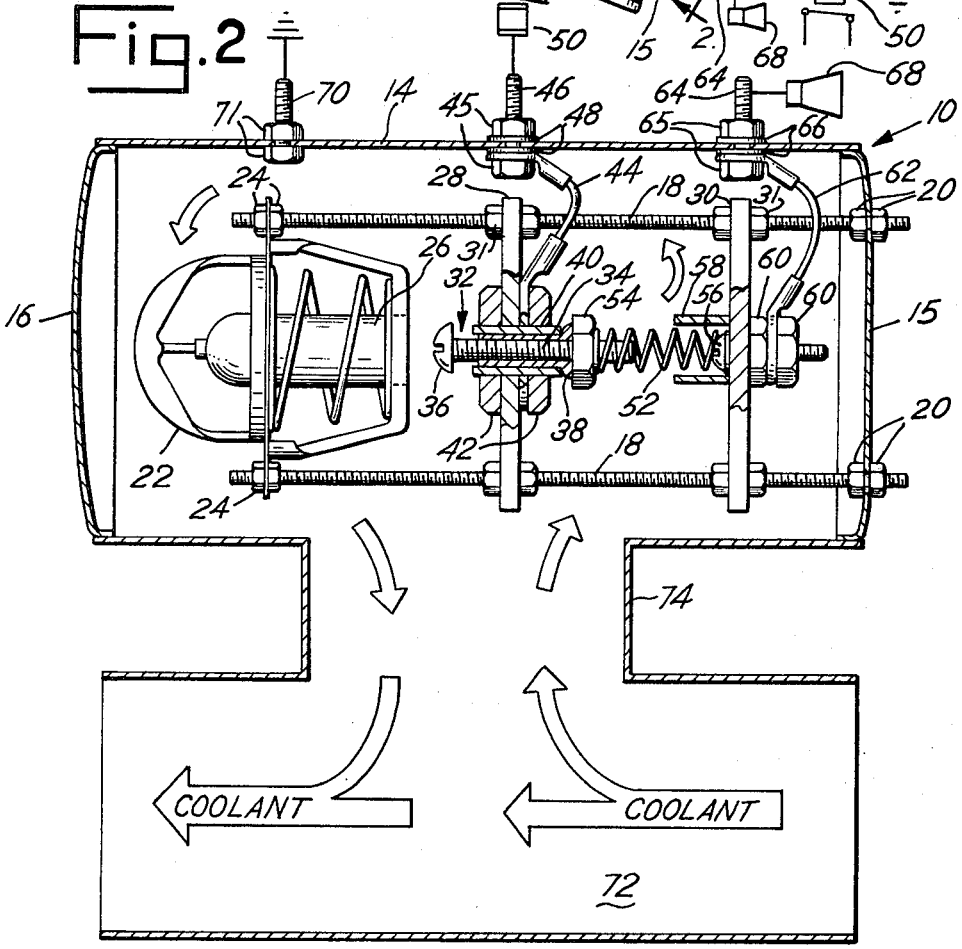
FIG. 2 is an enlarged cross sectioned side elevation view of the monitor as viewed substantially along line 2—2 of FIG. 1.

As shown more clearly in FIG. 2, the monitor 10 includes a closed housing 14 which is preferably cylindrical in cross section and which is closed at both ends by caps 15 and 16. Several threaded rods 18 extend longitudinally of the housing 14 and in generally parallel relation to its axis. One end of each of the rods is secured to one of the housing caps 15 by suitable means, such as nuts 20.

A thermostat element 22 is fixed at the other ends of the rods 18, such as by nuts 24. The thermostat element 22 may be a conventional internal combustion engine coolant thermostat, preferably having a setting of 190° F. The thermostat element 22 includes a movable element 26 which moves to the right as viewed in FIGS. 2–4 as the temperature of the coolant liquid increases. Operation of the thermostat element will not be described in detail because it may be a conventional engine coolant thermostat well within the selection of those in the automotive arts.

A pair of plates 28 and 30 are also mounted on rods 18 intermediate their ends as shown in FIG. 2, such as by nuts 31.

A plunger, preferably in the form of a bolt 32 having an elongate threaded shank 34 and a head 36, is mounted on plate 28 for sliding longitudinal movement in an electrically insulating sleeve 38. The insulating sleeve 38, in turn, is positioned in a conductive sleeve 40, as shown in FIG. 2, and sleeve 40 is held firmly to plate 28 by a pair of nuts 42 threaded onto sleeve 40 and against plate 28.

A conductor 44 is connected between the conductive sleeve 40 by one of the nuts 42 and a preferably threaded terminal 46 extending to the exterior of the housing 14. The terminal 46 is mounted to the housing by nuts 45 and the nuts and terminal are insulated from the conductive housing 14 by insulating washers 48. The terminal 46, in turn, is electrically connected, by a conductor external to housing 14, to a suitable engine cutoff mechanism, such as a normally closed relay 50 in the ignition system. When the terminal 46 is energized by conductor 44, the ignition system, preferably on the hot side of the ignition coil, is opened to cut off or shut down the engine.

A conductive spring 52 extends between a nut 54 threaded on the bolt or plunger 32 and a conductive screw 56 mounted to plate 30 as shown in FIG. 2. Thus, the conductive spring 52 is in electrical contact with the screw 56 at all times and the plate 30. A suitable guide sleeve 58 may also be provided on plate 30 to prevent buckling of the spring 52. Nuts 60 are provided on the bolt 56 on the opposite side of plate 30 from spring 52 to electrically attach the bolt to the plate and a conductor 62 to the bolt 56. The other end of conductor 62 is connected to a terminal 64 which extends to the exterior of the housing 14. The terminal 64 is mounted to the housing by nuts 65 and the nuts and terminal are insulated from the conductive housing by insulating washers 66. Terminal 64 is electrically connected, by a suitable conductor external to housing 14, to a warning device such as a light or buzzer 68.

In order to complete the circuits through either terminal 46 or 64, a ground terminal 70 is also attached to the exterior of the housing by nuts 71 and the nuts and terminal are in electrical contact with the housing 14.

A coupling member 72 is provided on the housing 14 as shown in FIGS. 1 and 2 and is coupled into the coolant circuit by the radiator hoses 12 as shown in FIG. 1. The coupling member 72 communicates with the interior of the housing 14 by way of a connecting conduit 74 to allow the coolant fluid to fill and completely bathe the elements in housing 14 with the coolant fluid on its way from the engine to the radiator 8.

Although it is believed that the operation of the just described preferred embodiment of fluid temperature monitor will be apparent from a consideration of the foregoing description, a brief description of the operation follows.

When the engine is running, the coolant fluid to be monitored will enter the coupling 72 on its way from the engine to the radiator because the coupling is coupled into the coolant circuit by the hoses 12 as shown in FIG. 1. The fluid will fill the housing 14 bathing the elements with the fluid. If the temperature of the coolant fluid rises to an overheating condition due to breaking of the fan belt or the like, the thermostat element 22 will respond to the increased temperature and its movable element 26 will move to the right as viewed in FIGS. 2–4.

Figure 3:
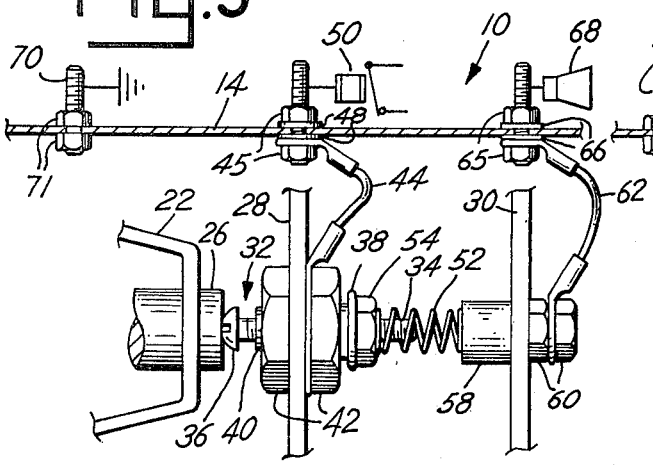
FIG. 3 is a broken cross sectioned side elevation view of the monitor of FIG. 2 showing the condition in which the monitor is actuating the overheating warning.

As element 26 moves to the right, it first will come into contact with the head 36 of the plunger or bolt 32 as shown in FIG. 3. When this switching contact is made, an electrical circuit will be established through ground 70, housing 14, bolts 18, thermostat 22, movable element 26, bolt head 36 of bolt 32, nut 54, spring 52, bolt 56, conductor 62 and terminal 64, energizing the warning device 68. When the warning device 68 shows or sounds, the vehicle operator is given advance warning that an overheating condition exists and that he should leave traffic before the engine is shut off.

Figure 4:
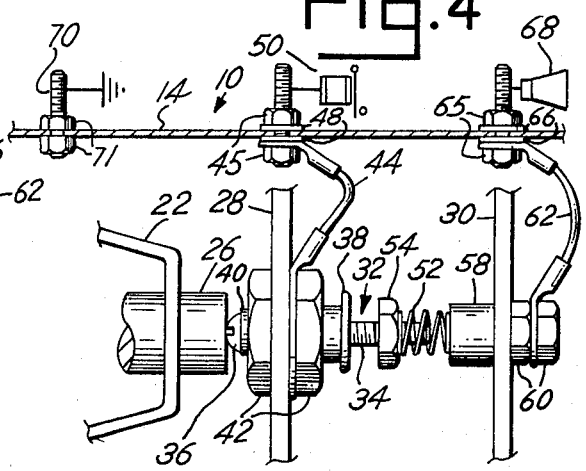
FIG. 4 is a broken cross sectioned side elevation view of the monitor of FIG. 2 showing the condition in which the monitor has shut off the engine.

If overheating continues, the movable element 26 will continue to move to the right as shown in FIG. 4, until the head 36 of the plunger or bolt 32 is moved into contact with the left end of conductive sleeve 40. This will preferably take a minute or so to allow the vehicle operator time to pull out of traffic before the engine is stopped. This time delay is of optional length and may be adjusted to be greater or less than a minute. When this switching contact is established between the plunger head 36 and the end of sleeve 40, an electrical circuit is established between ground terminal 70, housing 14, bolts 18, thermostat 22 and its movable element 26, plunger head 36, conductive sleeve 40, nuts 42, conductor 44 and terminal 46, energizing the engine cutoff element 50 to open the engine ignition system. The engine cutoff element 50 is preferably a normally closed relay switch or some other similar device which will reset itself automatically once the engine has cooled sufficiently to allow normal operation of the engine.

It will be understood that although the preferred embodiment of monitor has been described in terms of monitoring internal combustion engine coolant fluid, the monitor may also find other important uses such as temperature monitoring of transmission fluid to prevent overheating and damage to the transmission.

It will also be understood that the embodiment of the invention which has been described is merely illustrative of an application of the principles of the invention. Numerous modifications may be made by those skilled in the art without departing from the true spirit and scope of the invention.

What is claimed is:

1. A fluid temperature monitor for monitoring the temperature of a fluid comprising:

thermostat means operable in response to the temperature of the fluid, warning means, first switch means having first contacts which are actuated by said thermostat means to close and complete an electrical circuit to actuate said warning means when the temperature of said fluid reaches a predetermined level, prime mover cutoff means, second switch means having second contacts which are actuated by said thermostat means to close and complete an electrical circuit to actuate said prime mover cutoff means after said warning means has been actuated, and means for bathing said thermostat means and said contacts directly in said fluid being monitored.

2. The monitor of claim 1 wherein the fluid is the coolant fluid of an internal combustion engine and said monitor includes coupling means for coupling said monitor into the engine coolant fluid circuit.

3. The monitor of claim 1 wherein the prime mover cutoff means interrupts the ignition circuit of an internal combustion engine when said cutoff means is actuated.

4. The monitor of claim 1 wherein said first and second switch means comprise a movable plunger, said plunger actuating said warning means when contacted by said thermostat means and actuating said prime mover cutoff means when moved by said thermostat means.

5. The monitor of claim 1, wherein said means for bathing said thermostat means and contact means includes housing means enclosing said thermostat means and contact means, said fluid filling said housing means and surrounding said thermostat means and contact means.

6. The monitor of claim 1 wherein said fluid is a fluid associated with an internal combustion engine and said prime mover cutoff means interrupts the operation of the engine when it is actuated, said first and second switch means comprise a movable plunger, said plunger actuating said warning means when contacted by said thermostat means and actuating said prime mover cutoff means when moved by said thermostat means, said means for bathing said thermostat means and contact means includes housing means enclosing said thermostat means and contact means, said fluid filling said housing means and surrounding said thermostat means and contact means.

7. The monitor of claim 6 wherein the fluid is the coolant fluid of the engine and said monitor includes coupling means for coupling said monitor into the engine coolant fluid circuit.

8. A fluid temperature monitor for monitoring the temperature of a fluid comprising;

thermostat means operable in response to the temperature of the fluid;

warning means;

prime mover cutoff means;

switch means having contacts which are actuated by said thermostat means to actuate said warning means when the temperature of said fluid reaches a predetermined level;

delay means for actuating said prime mover cutoff means after said warning means is actuated; and housing means containing said thermostat means and said contacts, said housing means receiving said fluid to be monitored, said thermostat means and said contacts being bathed directly in said fluid in said housing means.

9. The monitor of claim 8, wherein the fluid is the coolant fluid of an engine and said monitor includes coupling means for coupling said monitor into the engine coolant fluid circuit.

10. The monitor of claim 8, wherein said thermostat means contacts said switch means to actuate said warning means and moves said switch means after contact to actuate said prime mover cutoff means.

* * * * *